US006626096B1

(12) United States Patent
Shoemaker, Jr.

(10) Patent No.: US 6,626,096 B1
(45) Date of Patent: Sep. 30, 2003

(54) REDEMPTION TICKET MAKER

(76) Inventor: Stephen P. Shoemaker, Jr., 140 The Village 401, Los Angeles, CA (US) 90001

( * ) Notice: Subject to any disclaimer, the term of this patent is extended or adjusted under 35 U.S.C. 154(b) by 0 days.

(21) Appl. No.: 09/711,061

(22) Filed: Nov. 9, 2000

(51) Int. Cl.[7] ..... B41L 45/00; B41F 19/02; B41J 3/24; B26D 7/06

(52) U.S. Cl. ..... 101/66; 101/19; 101/93.07; 101/304; 101/491; 83/430; 83/500; 83/501; 83/502; 83/503

(58) Field of Search ..... 101/66, 93.07, 101/491, 19; 83/430, 304, 500, 501, 502, 503

(56) References Cited

U.S. PATENT DOCUMENTS

| | | | | | |
|---|---|---|---|---|---|
| 3,586,149 | A | | 6/1971 | Miller | |
| 3,602,114 | A | | 8/1971 | Peters | |
| 3,658,364 | A | | 4/1972 | Da Mert | |
| 3,829,080 | A | | 8/1974 | Braen et al. | |
| 3,890,893 | A | * | 6/1975 | Kodis | 101/66 |
| 3,893,389 | A | * | 7/1975 | Kodis | 101/93.07 |
| 3,964,359 | A | * | 6/1976 | Westover | 83/430 |
| 4,074,599 | A | * | 2/1978 | Allen | 83/346 |
| 4,270,911 | A | | 6/1981 | McNew | |
| 4,289,556 | A | | 9/1981 | Booth | |
| 4,486,093 | A | | 12/1984 | McNew | |
| 4,527,923 | A | | 7/1985 | Waldman | |
| 4,615,929 | A | | 10/1986 | Alexander, Jr. | |
| 4,620,726 | A | | 11/1986 | Donnelly | |
| 4,730,847 | A | | 3/1988 | Donnelly | |
| 4,743,130 | A | | 5/1988 | Katagiri et al. | |
| 5,109,762 | A | | 5/1992 | Tetrault | |
| 5,183,436 | A | | 2/1993 | Shanley | |
| 5,671,678 | A | * | 9/1997 | Bolte et al. | 101/491 |
| 5,882,767 | A | | 3/1999 | Simmons, Jr. | |
| 6,105,479 | A | * | 8/2000 | Neier et al. | 83/304 |

FOREIGN PATENT DOCUMENTS

| | | |
|---|---|---|
| EP | 0270614 | 3/1994 |
| EP | 0675800 | 3/1998 |
| JP | 61172764 | 8/1986 |
| JP | 02025376 | 1/1990 |
| WO | 09926217 | 5/1999 |

* cited by examiner

*Primary Examiner*—Andrew H. Hirshfeld
*Assistant Examiner*—Marvin P Crenshaw
(74) *Attorney, Agent, or Firm*—Fulwider Patton Lee & Utecht, LLP

(57) ABSTRACT

A ticket making apparatus includes a feed mechanism and a perforating assembly set within a housing that has an opening through which tickets are dispensed. The perforating assembly perforates a flexible material to define individual tickets. The apparatus can also include a slicer assembly to slice the flexible material into strips of tickets. The apparatus can also include a printing mechanism for adding print to the flexible material. A method for making tickets includes feeding a flexible material into a perforating assembly and dispensing the perforated material as a plurality of tickets. The method can also include synchronizing the flexible material to the rotation of the perforating assembly, slicing the flexible material into strips of tickets, and printing on the flexible material.

5 Claims, 6 Drawing Sheets

REDEMPTION TICKET MAKER

BACKGROUND OF THE INVENTION

Tickets can be used as a means for exchange of goods and/or services. For example, amusement parks, theaters, and other public entertainment places can use tickets to ensure that customers have paid an admission fee before making use of the entertainment services. In other fields such as public transportation, tickets can provide a similar service.

Another field in which tickets and ticket dispensers are frequently used is the field of arcade games. Players of arcade games can win redemption tickets based on a final score or one or more achieved goals. The redemption tickets can then be redeemed for prizes offered at the arcade.

In a typical redemption-type arcade game, a ticket dispenser is positioned at a front panel or front area of a game unit, where players have easy access to dispensed tickets. Generally, a supply such as a fan fold of tickets is stored in a cache or compartment near the ticket dispenser within a game unit. The tickets are routed from the supply, through the dispensing mechanism, and through a front slot in the game unit out of which the tickets are dispensed. The dispensing mechanism may include one or more motor-driven rollers that move the strip of tickets. The operator of the game replaces the tickets when needed.

A problem with prior art redemption tickets is that the tickets are made of a heavy paper stock and are thus somewhat thick. This is not a problem in non-game uses of the tickets, since the tickets often need to be durable for handling purposes. In addition, for non-game uses, the ticket should be large enough that information can be printed on each ticket or on multiple tickets. These tickets are then suitable for random drawings and the like, and a ticket distributor can keep track of the numbers of tickets dispensed.

The same thick, larger-sized tickets were naturally brought over to redemption-type arcade games. However, this type of ticket has become inadequate for redemption-type game uses due to the evolution of arcade games. More specifically, additional features have been added to redemption arcade games, such as progressive bonus features. Such features require dispensing large amounts of tickets. For example, an arcade game unit including a progressive bonus feature can accumulate and then dispense a ticket award of 1000 or more tickets.

However, only a certain number of tickets may be stored at one time in the ticket supply space in a game unit, and that number clearly depends on the thickness of the tickets. Thicker tickets obviously reduce the number of tickets that can be stored in the dispenser, requires refreshing the dispenser more often, and limits the maximum number of tickets that can be conveniently awarded at a game unit without having to personally involve a game operator. In addition, highly accurate scales are now available to count large numbers of tickets. Previously, tickets needed to be thick to make ticket counting by hand easier. However, the new scales and other counting devices eliminate the need for manual counting and thus the need for thicker tickets.

Thus, what is desired is an apparatus and method to quickly, cheaply and easily make thinner tickets out of common and relatively inexpensive materials.

SUMMARY OF INVENTION

The present invention provides an apparatus and a method for creating thin strips of perforated tickets. The tickets are made from common and inexpensive starting materials. The apparatus and method are suited to quickly and inexpensively make large numbers of thin tickets.

An apparatus for making tickets according to the present invention includes a housing with an opening through which completed tickets can be removed, and preferably a reservoir for a supply of a continuous flexible material. Attached to the housing is a perforating assembly including a generally cylindrical perforator rotatably coupled to the housing and a cylindrical platen also rotatably coupled to the housing. The perforator is provided with a plurality of perforating knives positioned so as to make lateral perforations in the flexible material. The platen is positioned proximate to the perforator so that the material is pinched between the perforator and the platen. The apparatus also includes a feed mechanism configured to feed the flexible material from the reservoir and through the perforating assembly.

Preferably, the continuous flexible material has first and second edges and includes a plurality of longitudinally spaced tractor holes proximate to each edge, for example fan-folded computer paper. A preferred feed mechanism engages the longitudinally spaced tractor holes of the material with a plurality of tractor feed pins configured to engage the tractor holes. The tractor feed pins can be arranged, for example, circumferencially around the platen proximate to the perforator.

Pre-folded flexible material as-provided typically includes a plurality of pre-existing lateral perforations coinciding with the folds that divide the flexible material into a plurality of sections. Each section has, therefore, essentially the same length. The section length is defined as the distance between adjacent pre-existing lateral perforations/folds. To accommodate such material, the perforator can have a circumference substantially equal to the section length and include a blank space. Further, the perforator can be synchronized with the flexible material. In this way, with each revolution of the perforator the blank space contacts a pre-existing perforation. In other embodiments the circumference of the perforator can be substantially equal to an integer multiple of the section length. In these embodiments the perforator can include the same integer number of blank spaces spaced substantially equally around the perforator with perforating knives disposed between them. The perforator can then be synchronized with the flexible material so that each of the integer number of blank spaces contacts a pre-existing perforation with each revolution of the perforator.

The apparatus may also include a slicing assembly comprising a generally cylindrical slicer and a generally cylindrical second platen set proximate to one another so that the flexible material is pinched between them. Both the slicer and the second platen are rotatably coupled to the housing. The slicer includes at least one slicer blade positioned circumferencially around the slicer so as to make at least one substantially continuous longitudinal slice in the flexible material. Further, the apparatus may also include a printing mechanism disposed within the housing and configured to print on the flexible material.

The apparatus of the present invention produces at least one continuous strip of tickets from the continuous flexible material by introducing additional lateral perforations between the pre-existing lateral perforations. A printing mechanism can add indicia to the tickets. A slicer can further divide the flexible material into a plurality of continuous strips of tickets. Thus, a strip of tickets will include both ticket perforations that define each ticket, and sectional perforations that define sections of tickets. The sectional perforations are the same as the pre-existing lateral perforations. Thus, it will be apparent that a section of tickets is the number of tickets that will span a section of the flexible material.

A method for making tickets according to the present invention includes loading a supply of a continuous pre-folded flexible material into a reservoir configured to hold the supply, perforating the flexible material by feeding it through a perforating assembly, and then re-folding the resultant tickets. The method can additionally include synchronizing the perforating assembly with the flexible material. The method can further include slicing the flexible material by feeding it through a slicing assembly, and printing on the flexible material by feeding it through a printing mechanism.

These and other advantages of the present invention will become apparent to those skilled in the art after reading the following descriptions and studying the various figures of the drawings.

DETAILED DESCRIPTION OF THE PREFERRED EMBODIMENTS

An improved ticket maker and tickets produced thereby of the present invention can be used for a variety of applications that require tickets to be used for exchange of goods and/or services. For example, the tickets can be used for entertainment purposes, as in arcades, amusement parks, theaters, and the like; transportation services, such as trains, buses, etc.; and so on. The present invention, however, is particularly well suited to making tickets for games, specifically arcade redemption-type games that provide tickets as an award to the games' players. It is with this field in mind that the present invention will be described, though wider applicability is envisioned.

The invention makes tickets out of most any continuous pre-folded flexible material having longitudinally spaced tractor holes and having discrete sections defined by pre-existing lateral perforations. A preferred type of flexible material that is inexpensive and readily available is fan-folded computer paper. Perforation, as used herein, is meant to refer to any technique suitable for dividing the material into individual tickets or that would facilitate its separation into individual tickets or sections. Perforation can thus be scoring, producing a row of discrete holes, and so forth.

Figure 1:
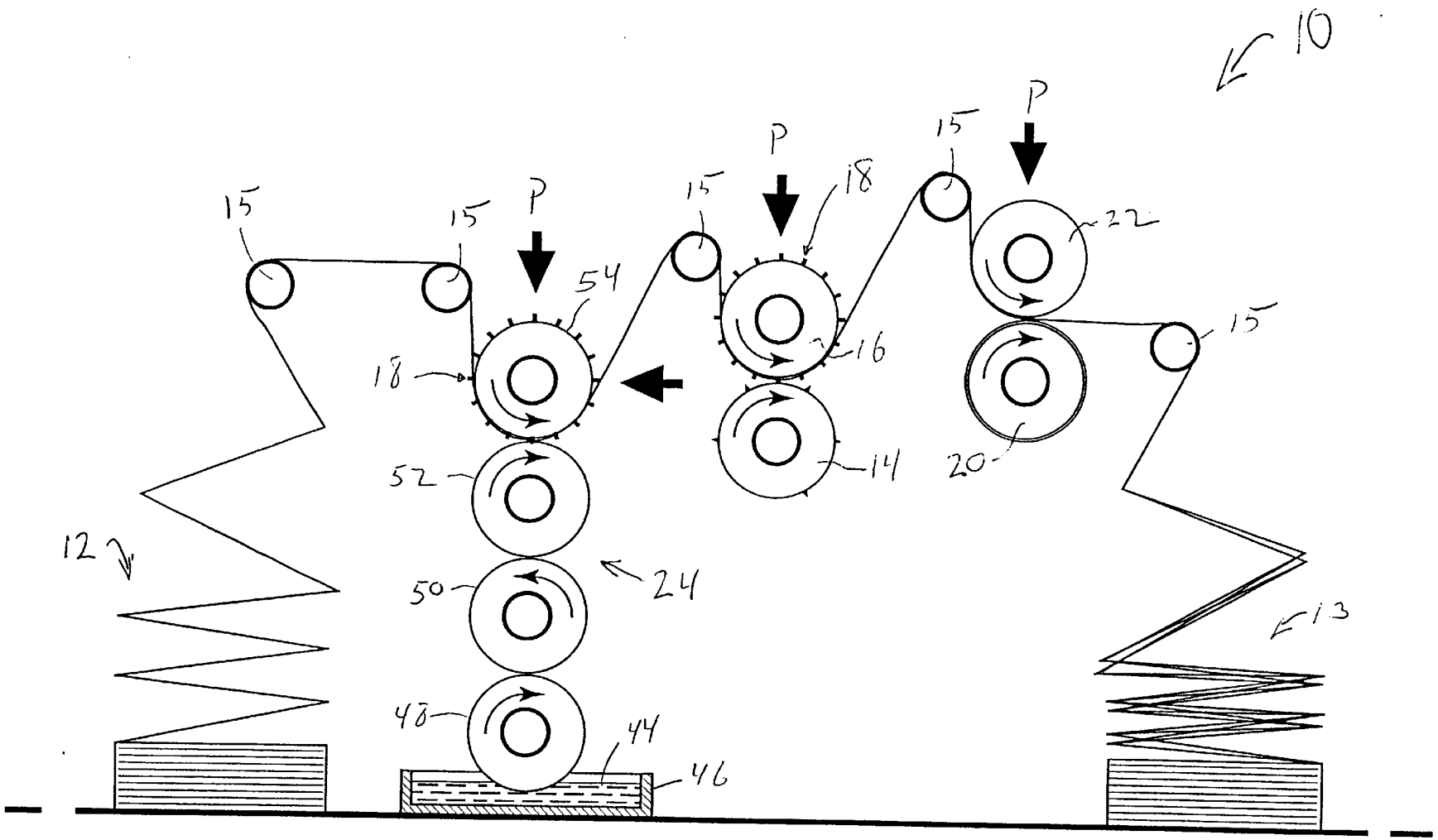
FIG. 1 is a schematic diagram of an embodiment of an apparatus of the present invention.

FIG. 1 is a side view of an apparatus 10 for perforating a continuous flexible material 12 to make tickets 13, particularly redemption tickets 13, in accordance with the method of the present invention, described below. The apparatus 10 includes a perforator 14 and a first platen 16, a slicer 20 and a second platen 22, and in some embodiments a printing mechanism 24. The apparatus 10 further includes a plurality of rollers 15 to guide the flexible material 12 through the apparatus 10. In some embodiments one or more of the rollers 15 may additionally be tensioners that hold the flexible material taut. When the flexible material 12 is pre-folded as-provided, the tickets 13 produced by apparatus 10 tend to form stacks by re-folding along the pre-existing folds.

While it will be appreciated by those skilled in the art that certain benefits are achieved by arranging printing mechanism 24 before perforator 14, and perforator 14 before slicer 20, the other possible permutations will also work to produce tickets 13 from the flexible material 12 and are meant to be included within the scope of the present invention. Moreover, the present invention envisions the addition of further mechanisms (not shown) for achieving specialized functions such as an embossing mechanism to emboss the flexible material 12, or a numbering mechanism to add sequential numbers. Such additional mechanisms can be located either before or after any of the detailed mechanisms 14, 20, 24 though some arrangements will obviously be more desirable than others.

Figure 2A:
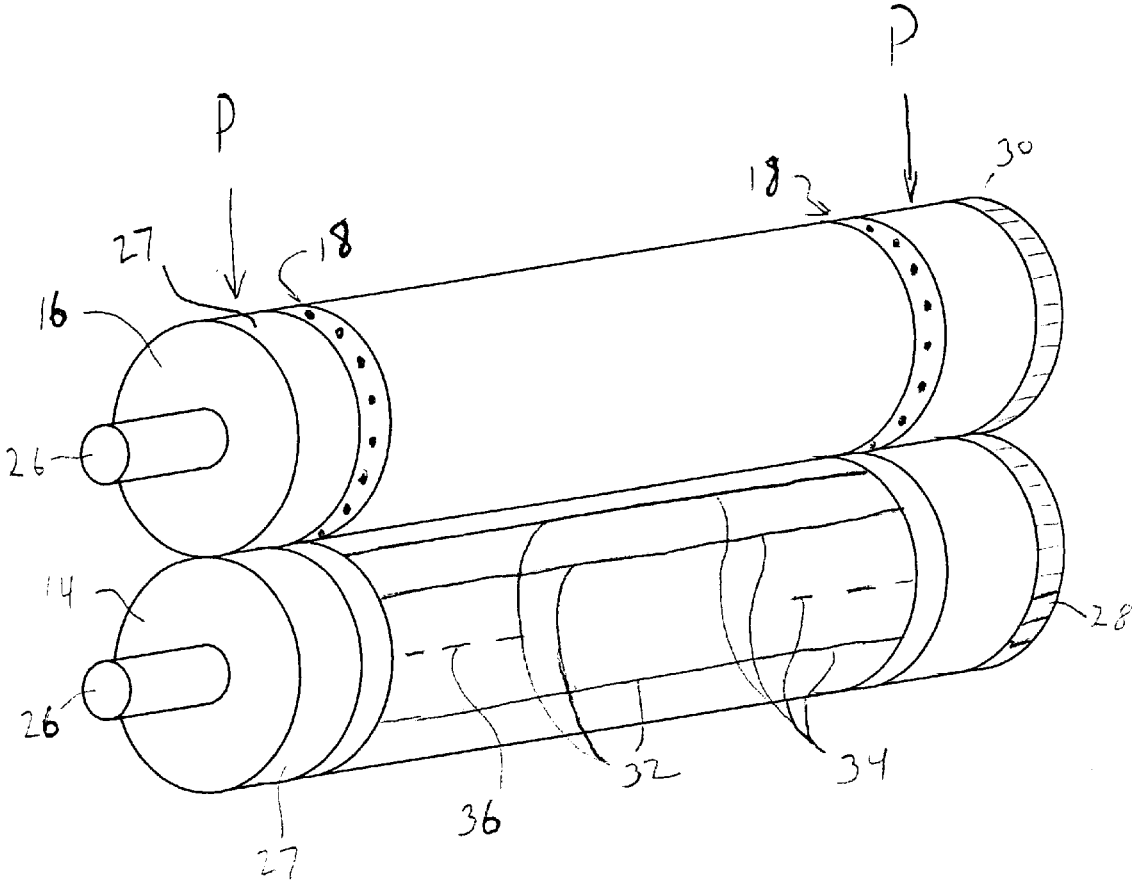
FIG. 2A is a plan view of a perforator and its associated platen.

FIG. 2A is a plan view of the preferred embodiments of the perforator 14 and first platen 16. Both are essentially specialized rollers, cylindrical in shape, each provided with an axle 26, or similar mechanism such as a bearing, for rotation about each's long axis and for securing each within a housing (not shown). Either or both the perforator 14 and the platen 16 preferably include a smooth surface 27 provided to contact a pressure roller (not shown) in order to apply pressure between the perforator 14 and the platen 16. Such a roller would provide pressure in a direction shown by arrow P where a pressure roller is configured to apply pressure to smooth surface 27 of the platen 16. The application of pressure helps to pinch the flexible material 12 between the perforator 14 and the platen 16, helping to ensure that the flexible material 12 is completely perforated as the flexible material 12 is passed between.

Platen 16 preferably includes a feed mechanism such as that provided by tractor feed pins 18. It will be appreciated that perforator 14 should include corresponding holes or grooves to engage feed pins 18 to register the flexible material 12 as it is passed through. Tractor feed pins 18 are uniformly spaced circumferencially in two or more parallel rings around the platen 16. The feed pins 18 engage longitudinally spaced tractor holes in the flexible material 12 in order to feed the flexible material 12 between the perforator 14 and the platen 16. A motor (not shown), or some other drive mechanism, is preferably connected to the perforator 14 to drive the perforator 14 and the platen 16.

The perforator 14 and platen 16 are preferably synchronized, which can be achieved with gears 28 and 30, disposed on perforator 14 and platen 16, respectively. Synchronizing the perforator 14 with the platen 16 allows the tractor feed pins 18 to feed the flexible material 12 controllably such that perforations fall in the same location on each discrete section. Further, synchronization also ensures that the perforator 14 does not perforate the flexible material 12 at the pre-existing lateral perforations. Perforating the flexible material 12 at the pre-existing lateral perforations should be avoided because it could weaken the continuous flexible material 12, and cause the pre-existing lateral perforations and the newly created perforations to have unequal strengths.

Perforator 14 further includes a plurality of perforating knives 32 situated at locations 34 around the perforator 14. In alternative embodiments the perforator 14 can be configured, for example, with a plurality of devices required to score the flexible material 12, rather than the knives 32 of the preferred embodiment. Preferably, the locations 34 are evenly spaced, and there is a perforating knife 32 at each location 34 except one, a blank space 36, described below, provided to accommodate the pre-existing lateral perforations 38.

Figure 2B:
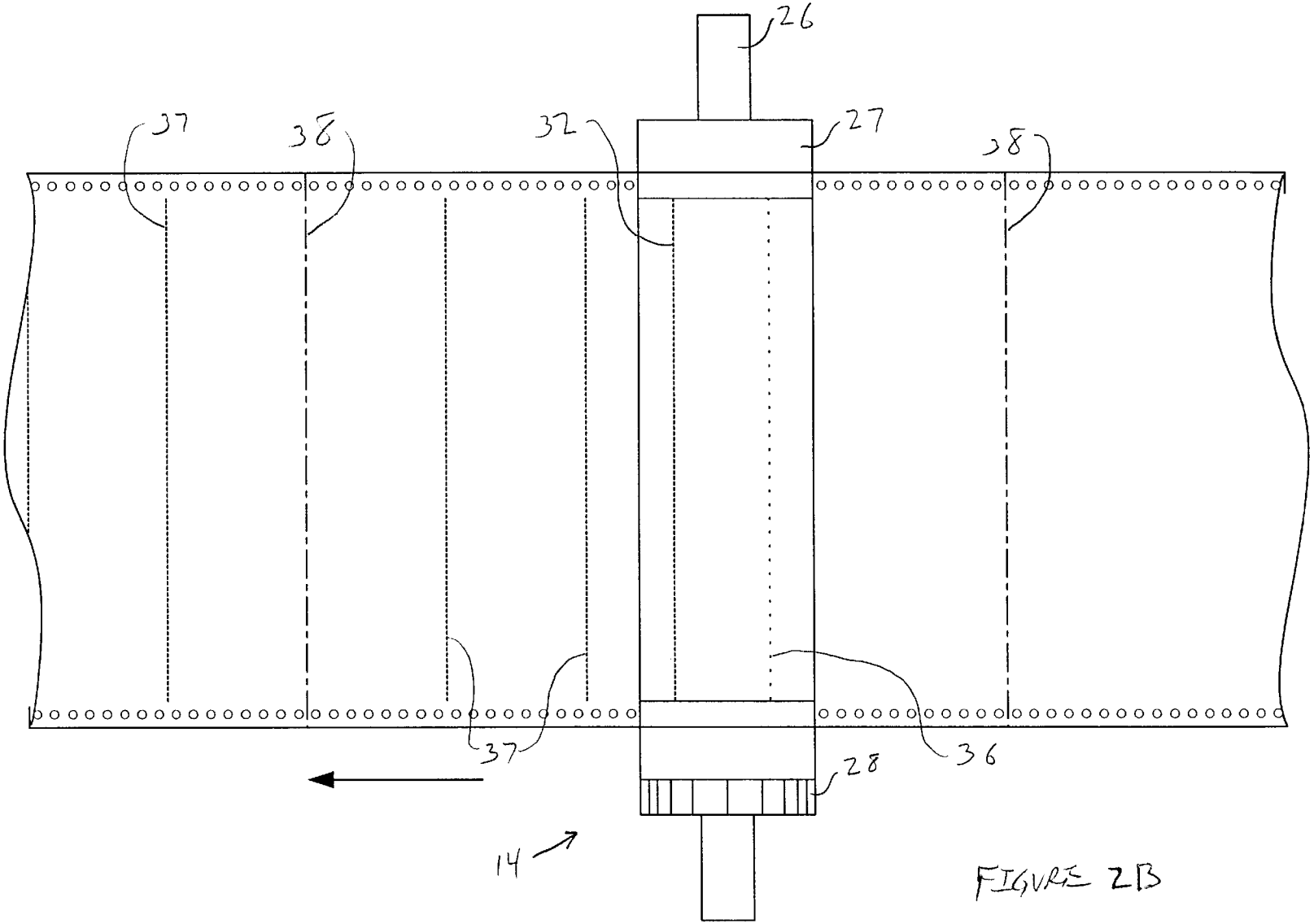
FIG. 2B is a bottom view of a flexible material passing between the perforator and platen.

FIG. 2B is a bottom view taken along line 2B—2B of FIG. 2A. As can be seen in FIG. 2B, as the strip of flexible material 12 passes above the perforator 14 the perforating knives 32 come into contact with the flexible material 12 and create perforations 37 perpendicular to the long axis of the strip of flexible material 12. However, as the pre-existing perforation 38 that divides the continuous flexible material 12 into sheets passes between the perforator 14 and platen 16, it comes in contact with the blank space 36, where no perforating knife has been placed. Thus, the pre-existing perforation 38 is left intact, so as not to excessively weaken the flexible material 12 at this point.

It will be appreciated that the effort it takes to tear the flexible material 12 along a perforation 37, 38 will depend on several factors. In particular, one important factor will be the number of perforations per inch. Another factor is whether the flexible material 12 has been folded along the perforation 37, 38. For example, fan-folded computer paper is folded along pre-existing perforations 38 causing a further reduction in strength in those perforations 38 causing them to tear more easily. In some embodiments it is desirable to match the strength of the perforations 37 to that of the pre-existing perforations 38. This can be accomplished, for example, by increasing the number of perforations per inch over that of the perforations 38. For instance, a perforation 38 might have 10 perforations per inch and have been folded once, yielding a certain tear strength. To create the same tear strength in a perforation 37 it might be necessary to use perforating knives 32 capable of creating 20 perforations per inch. By tailoring the two tear strengths to be substantially the same the apparatus 10 will produce a strip of tickets 13 from which any ticket 13 will tear with essentially the same effort.

It will be apparent that in order for the blank space 36 to align with the pre-existing perforation 38 the perforator 14 must be synchronized with the flexible material 12. This will be possible only when the perforator 14 has a circumference that is equal to the length of a section of the flexible material 12. It will be appreciated, of course, that the perforator 14 could, for example, have a circumference equal to twice the length of a section of flexible material 12 and be configured with two blank spaces 36 set opposite one another. In any event, it will be further appreciated that some synchronization method will have to be undertaken in order to ensure that each pre-existing perforation 38 will align with a blank space 36. Methods for alignment will be further discussed below with reference to the method of the invention.

As each section of flexible material 12 passes between the perforator 14 and platen 16 it is perforated a predetermined number of times, where that number is equal to the number of perforating knives 32 on the perforator 14. In those embodiments where the circumference of perforator 14 is a multiple of the length of a section, the number of perforations created on each section of flexible material 12 will equal the number of knives 32 between each set of blank spaces 36. Thus it will be appreciated that to cut each section of flexible material 12 into X rows of tickets 13, it is preferable to use X-1 perforating knives 32 and one blank space 36. For example, to divide each section into five rows of tickets 13, it is preferable to use four perforating knives 32 and a blank space 36. In this case, each knife 32 contacts each section, and the blank space 36 contacts each pre-existing perforation 38.

Figure 3:
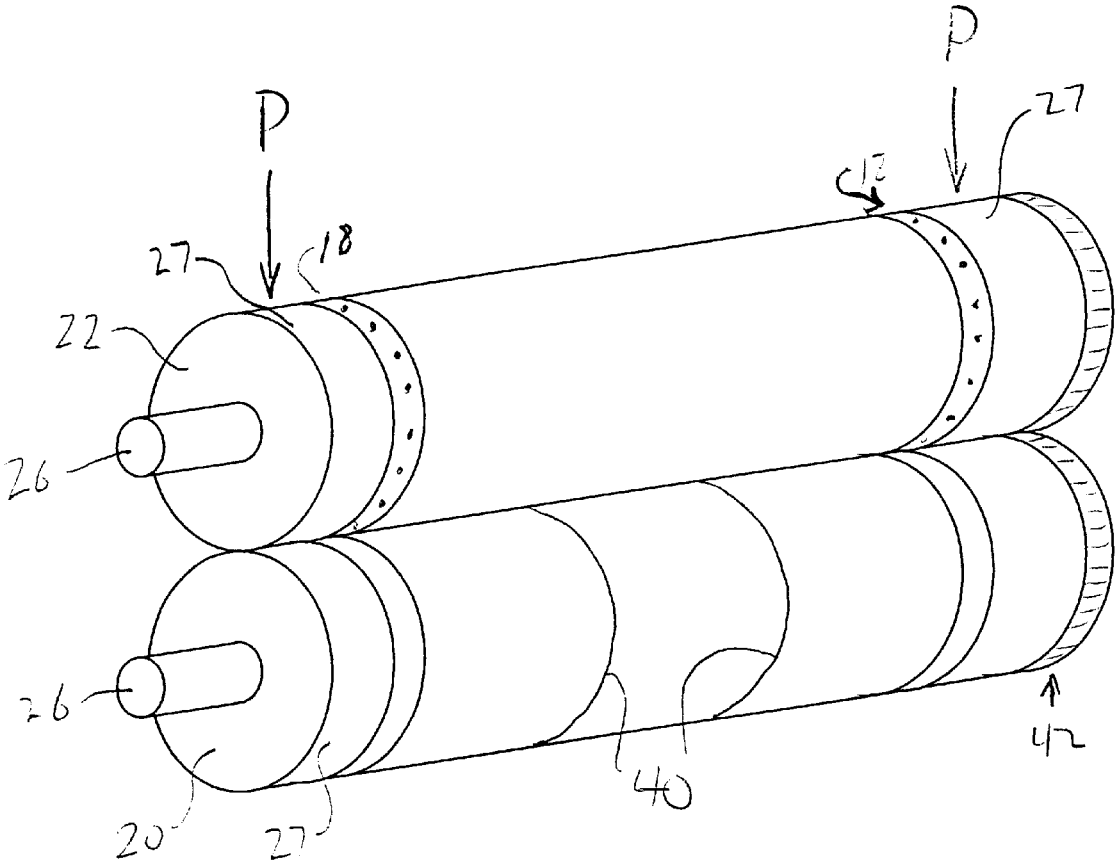
FIG. 3 is a plan view of a slicer and its associated platen.

Preferably, flexible material 12 is sliced after being perforated. In the embodiment shown in FIG. 1, after the flexible material 12 is perforated it passes between a generally cylindrical slicer 20 and a second platen 22. FIG. 3 is a plan view of the slicer 20 and second platen 22. The slicer blades 40 make continuous longitudinal cuts in the flexible material 12. It will be appreciated that in certain embodiments the slicer 20 and second platen 22 will be unnecessary, for example, where the flexible material 12 is a narrow strip such as a cash register tape that is intended to be made into a single continuous strip of tickets 13.

Pressure is preferably applied to the second platen 22 so that the flexible material, 12 is pinched between the slicer 20 and the second platen 22, helping to ensure that the flexible material 12 is sliced as it passes between the slicer 20 and second platen 22. Preferably, the pressure is applied via pressure rollers (not shown) to a flat surface 27 on the platen 22, or in an alternative embodiment, to a flat surface 27 on the slicer 20. Gearing 42 may be included, but synchronization as discussed with respect to the perforator 14 is not necessary here. Similarly, platen 22 may include a feed mechanism such as that provided by tractor feed pins 18. The discussion above with respect to pins 18 disposed on first platen 16 or perforator 14 apply equally to second platen 22 and slicer 20.

As previously mentioned, in some embodiments the flexible material 12 may be printed by one or more printing mechanisms 24 prior to being perforated. If the flexible material 12 is to be printed, standard printing processes known by those skilled in the art can be used. In the embodiment shown in FIG. 1 a process commonly referred to as flexographic printing is illustrated as one possible printing mechanism 24. In printing mechanism 24 ink 44 is held in a container 46. A first cylindrical roller 48 with a rubber surface is positioned so that part of the rubber surface is in contact with the ink 44 in the container 46. As the first roller 48 rotates, it picks up ink 44 from the ink container 46. The first cylindrical roller 48 is in contact with a second analog roller 50. Ink 44 is transferred from the first roller 48 to the second analog roller 50. The second roller 50 is in contact with a third cylindrical print roller 52 that includes an image to be transferred to the flexible material 12. Ink 44 is transferred from the second analog roller 50 to the third roller 52. The flexible material 12 passes between the third roller 52 and a fourth feed roller 54. The fourth roller 54 has tractor feed pins 18, or some other feed mechanism, to feed the flexible material 12 between the rollers 52, 54. Pressure is preferably applied to the fourth roller 54 so the fourth roller 54 presses the flexible material 12 against the third print roller 52. It will be apparent that ink 44 is transferred from the image to be printed located on the third roller 52 to the flexible material 12, creating print thereon.

It should be noted that printing mechanism 24 can include a plurality of flexographic printers in series depending on the number of colors and sides of the flexible material 12 to be printed. It will also be appreciated that other printing technologies can be adapted to the present invention. For example, thermal printing could be carried out where the flexible material 12 is a thermally sensitive paper, and in such an embodiment printing mechanism 24 would be replaced with a thermal printing mechanism.

It will be apparent that in order for the print to align with the tickets 13 the third roller 52 must be synchronized with the flexible material 12. This will be possible only when the third roller 52 has a circumference that is equal to the length of a section of the flexible material 12. It will be appreciated, of course, that the third roller 52 could, for example, have a circumference equal to twice the length of a section of flexible material 12 and be configured with two sets of images to be printed set opposite one another. In any event, it will be further appreciated that some alignment method will have to be undertaken in order to ensure that the top of each printed image aligns with the top of each section of flexible material 12. Methods for synchronization will be further discussed below with reference to the method of the invention.

Figure 4:
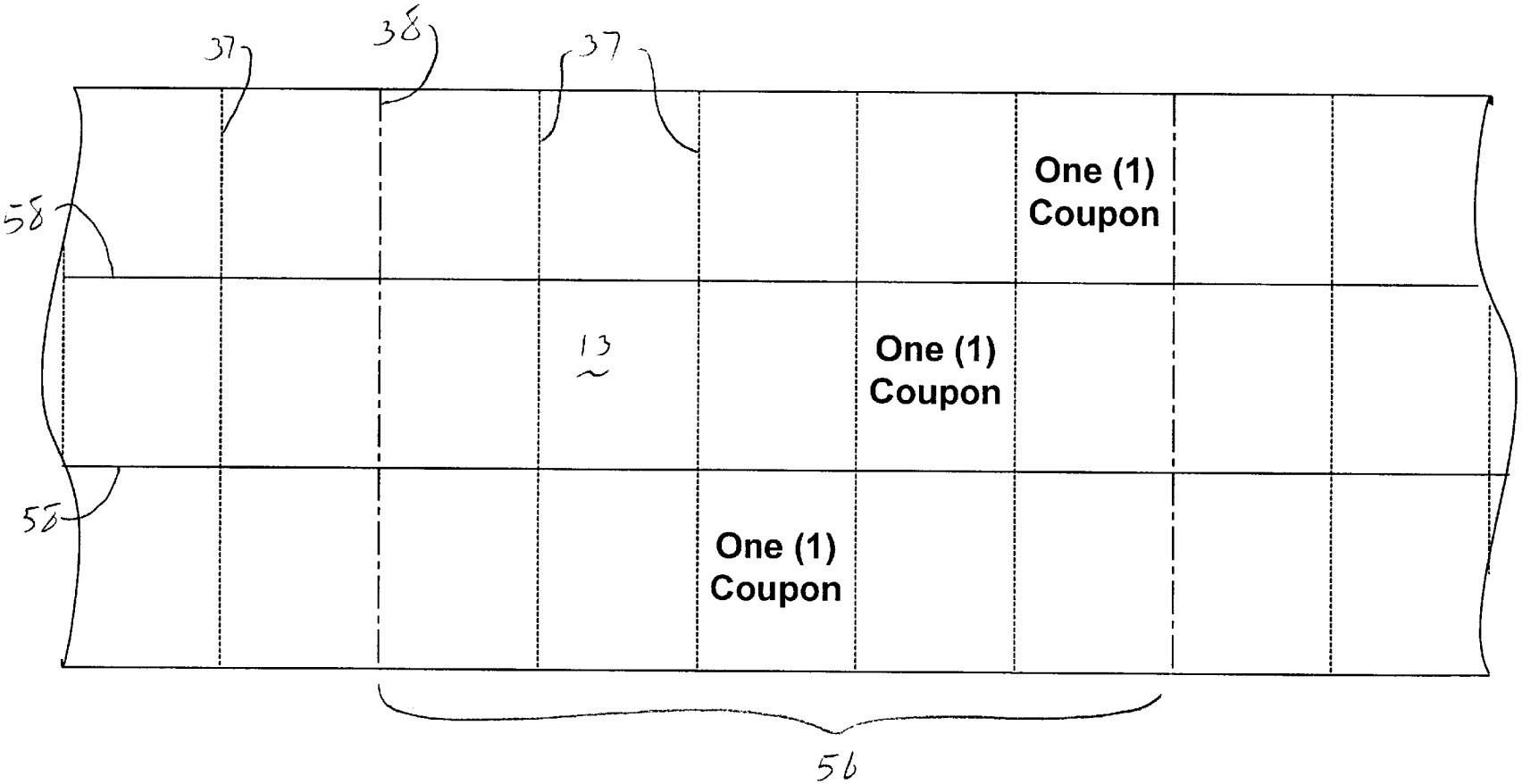
FIG. 4 is top view of a flexible material having being perforated and sliced to create a plurality of tickets.

FIG. 4 shows a continuous flexible material 12 after it has been processed into a plurality of tickets 13 by the apparatus 10 of the present invention. In the illustration it can be seen that a section 56 of the flexible material 12 has been divided up into three strips of five tickets 13 to create 15 tickets 13 per section 56. The individual strips are separated by continuous longitudinal cuts 58 produced by the slicer blades 40. As will be readily appreciated, by increasing or decreasing the number of perforator knives 32 and slicer blades 40 the number of strips and the number of tickets 13 per strip may be adjusted.

Figure 5:
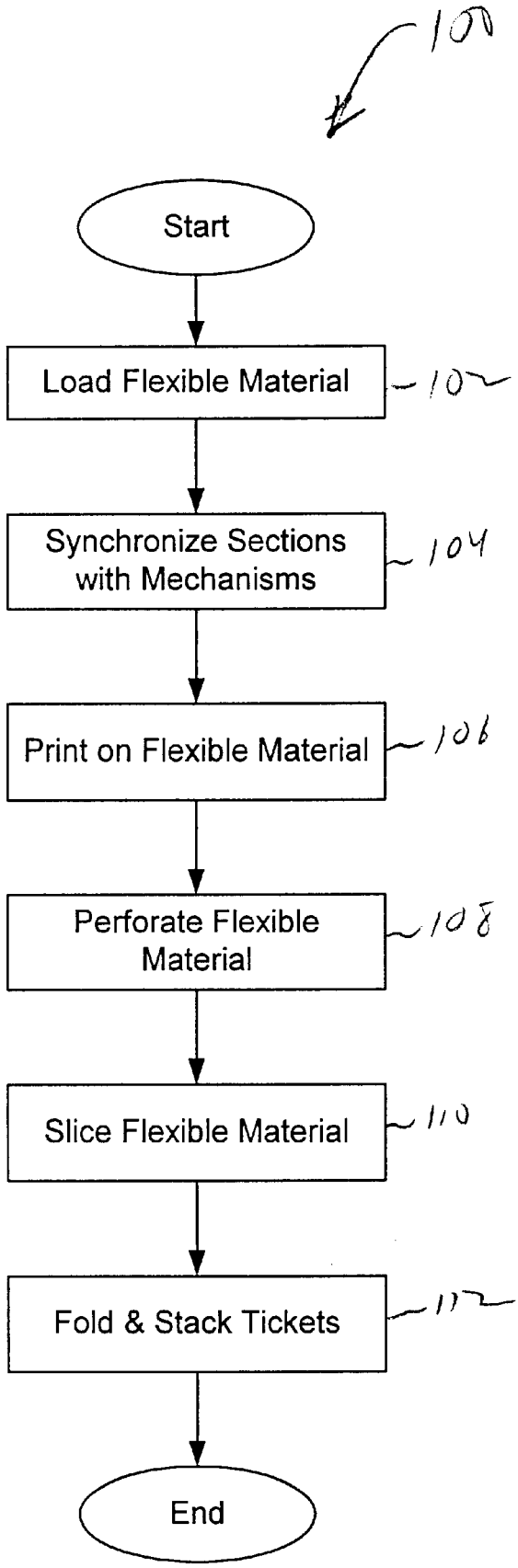
FIG. 5 is a flow chart showing an embodiment of a method of the present invention.

FIG. 5 is a flow chart showing the method 100 of the present invention. In act or operation 102 the flexible material 12 is loaded into a reservoir configured to hold a supply of flexible material 12. Where the flexible material 12 is computer paper, for example, the reservoir would be of a size adequate to accommodate a stack of computer paper.

Further in act or operation 102 the flexible material 12 is feed into the apparatus 10 such that it passes through all of the appropriate mechanisms. In some embodiments this is accomplished by feeding a free end of the flexible material 12 into a set of rollers where it is securely grabbed and automatically routed through the remainder of the apparatus 10. Such automatic loading mechanisms are well known in the art. In other embodiments an operator manually feeds the flexible material through the apparatus 10. Such manual feeding can be made easier by removing the pressure applied to the various platens 18, 22, 54, for example, by moving a lever configured to lift the various pressure rollers away from their respective platens 18, 22, 54.

In act or operation 104 the perforator 14, and in some embodiments the printing mechanism 24, are synchronized with the pre-existing perforations 38 of the flexible material 12. Synchronization in act or operation 104 can be accomplished in many different ways, of which two will be illustrated. One method that is applicable to the perforator 14 is to release the pressure applied to platen 16, feed the flexible material between the perforator 14 and platen 16 until a pre-existing perforation 38 is at the topmost point of the perforator 14, and then manually rotate the perforator 14 until a blank space 36 contacts the pre-existing perforation 38. A similar manual adjustment process can be carried out with respect to the printing mechanism 24.

Another method for synchronization is to color code two pins 18 that fall on opposite sides of blank space 36. An operator can then release the pressure applied to platen 16, feed the flexible material between the perforator 14 and platen 16 until a pre-existing perforation 38 falls between the two color coded pins 18. Next, the operator presses the flexible material 12 against the platen 16 such that one color coded pin 18 engages a tractor hole on one side of pre-existing perforation 38 and the other color coded pin 18 engages a tractor hole on the opposite side of pre-existing perforation 38.

In act or operation 106 the flexible material 12 passes between third roller 52 and fourth roller 54 in order that third roller 52 may print on one side of the flexible material 12. This act or operation is preferred though not essential to the present invention as the flexible material 12 may be supplied already printed or may be cut into tickets 13 that are blank. As previously discussed with reference to the apparatus 10 of the present invention, printing mechanism 24 is only one of many possible mechanisms for creating print on a flexible material 12. In act or operation 106 any other printing mechanism that can be configured to print on a continuously traveling flexible material 12 can be used to print on the flexible material 12.

In particular it may be desirable to print indicia on the flexible material 12 so that each ticket 13, or sheet 56 of tickets 13, carries the indicia. Indicia can specify information that the ticket manufacturer or vendor wishes to advertise or portray to game players or other receivers of the tickets. Such information can include the ticket vendor name, arcade game vendor name, exchange rate of the tickets, disclaimers or statements of ticket use, etc. It will be appreciated that an image, for example, can be printed on each ticket 13, or can be made to span two or more tickets 13, or can span an entire sheet 56.

In act or operation 108 the flexible material 12 is perforated by passing between the perforator 14 and the first platen 16. In the preferred embodiment, perforating knives 32 fixed to the perforator 14 rotate into contact with the flexible material 12 and are pressed into, or through, the flexible material 12 as the flexible material 12 becomes pinched between the edge of a knife 32 and the platen 16. The edge of the knives 32 preferably are serrated so as not to completely separate the flexible material 12. The pressure applied, for example, by a pressure roller can be adjusted until the degree of perforation is optimized. As previously discussed with reference to the apparatus 10 of the present invention, perforator 14 is only one of many possible techniques suitable for dividing the material 12 into tickets 13 or that would facilitate its separation into tickets 13. In act or operation 108 any other mechanism that can be configured to perforate a continuously traveling flexible material 12 can be employed.

In act or operation 110 the flexible material 12 is sliced by passing between the slicer 20 and the second platen 22. In the preferred embodiment, slicer blades 40 fixed to the slicer 20 make continuous longitudinal cuts in the flexible material 12 as the slicer blades 40 are pressed into the flexible material 12 as the flexible material 12 becomes pinched between the slicer 20 and the second platen 22. The number of blades 40 will determine the number of strips of tickets 13 that will be produced. For X blades 40 their will be X+1 strips of tickets 13 made. It will be appreciated that in act or operation 110 serrated blades can be used as blades 40 in order to create continuous longitudinal perforations so that sheets of tickets 13 are produced rather than a number of parallel strips of tickets 13. As in act or operation 108, the pressure applied by a pressure roller or some other device can be adjusted until the proper degree of slicing is obtained. With a low amount of applied pressure to the second platen 22 the slicer 20 can serve to score the flexible material 12, rather than slice it, to create continuous longitudinal score lines.

In act or operation 112 the strips or sheets of tickets 13 are re-folded and stacked within the housing of the apparatus 10. Where the flexible material 12 is pre-folded, such as with fan-folded computer paper, the strips of tickets 13 naturally tend to re-fold along the original pre-existing perforations 38 to form uniform stacks. The finished'stacks of tickets 13 may then be removed from the housing and distributed.

It will be appreciated by those skilled in the art that the order of these acts or operations can be varied and still be within the scope of the method 100 of the present invention. For example, in some embodiments act or operation 106 may follow act or operation 108 so that printing follows perforating.

While this invention has been described in terms of several preferred embodiments, it is contemplated that alterations, modifications and permutations thereof will become apparent to those skilled in the art upon reading of the specification and study of the drawings. It is therefore intended that the following appended claims include all such alterations, modifications and permutations as fall within the true spirit and scope of the present invention.

What is claimed is:

1. A ticket making apparatus comprising:

a feed system for drawing paper from a stack of fan-folded, sheets connected together at pre-existing perforations, said drive system employing pins circumferentially disposed about a plurality of rotating rollers, to engage longitudinally spaced apart tractor holes on said paper to move said paper through said apparatus;

a perforating station for perforating the paper at intervals defined by a predetermined ticket length as said feed system directs said paper therethrough, said perforating station including a cylindrical platen cooperating with a rotating cylindrical perforator wherein the paper is fed between the cylindrical platen and the rotating cylindrical perforator, the perforator having a circumference equal to an integer number of sheets, said cylindrical perforator having radially spaced-apart rows of knives where the length of the arc on the cylindrical perforator's circumference between said rows is one ticket length, except a row of knives is omitted at intervals defined on said circumference of the perforator defining one sheet length, and wherein feed system is synchronized with the perforating station such that a location of each missing row of knives coincides with a location of the pre-existing perforation of the paper as the paper is fed through the perforating station.

2. The ticket making apparatus of claim 1 wherein the circumference of the cylindrical perforator is equal in length to one sheet of the fan-folded paper.

3. The ticket making apparatus of claim 1 further comprising a ticket printing station for incorporating print on said paper.

4. The ticket making apparatus of claim 1 further comprising a slicing assembly, said slicing assembly comprising:

a rotatable cylindrical member including at least one continuous, circumferential blade; and a rotating cylindrical platen cooperating with the rotatable cylindrical member to frictionally move said paper therebetween;

wherein the at least one continuous, circumferential blade slices the paper as the paper passes between the cylindrical member and the rotating cylindrical platen.

5. The ticket making apparatus of claim 1 wherein the knives are selected and positioned to perforate the paper to an approximate degree of the pre-existing perforations.

* * * * *